US009174756B2

(12) United States Patent
Izawa et al.

(10) Patent No.: US 9,174,756 B2
(45) Date of Patent: Nov. 3, 2015

(54) LABEL PAPER WASTE REMOVING METHOD AND APPARATUS

(71) Applicants: Hideo Izawa, Narashino (JP); Reishi Fujiwara, Daisen (JP)

(72) Inventors: Hideo Izawa, Narashino (JP); Reishi Fujiwara, Daisen (JP)

(73) Assignee: MIYAKOSHI PRINTING MACHINERY CO., LTD., Narashino-shi (JP)

( * ) Notice: Subject to any disclaimer, the term of this patent is extended or adjusted under 35 U.S.C. 154(b) by 188 days.

(21) Appl. No.: 13/951,677

(22) Filed: Jul. 26, 2013

(65) Prior Publication Data

US 2014/0041808 A1 Feb. 13, 2014

(30) Foreign Application Priority Data

Aug. 7, 2012 (JP) ..... 2012-174560

(51) Int. Cl.

*B32B 38/10* (2006.01)
*B65C 9/00* (2006.01)
*B31D 1/02* (2006.01)

(52) U.S. Cl.

CPC ..... *B65C 9/0006* (2013.01); *B31D 1/021* (2013.01); *B31D 1/026* (2013.01); *B31D 1/027* (2013.01); *Y10T 156/1195* (2015.01); *Y10T 156/1994* (2015.01)

(58) Field of Classification Search

CPC ..... B32B 43/006; Y10T 156/108; Y10T 156/1195; Y10T 156/1994

See application file for complete search history.

(56) References Cited

U.S. PATENT DOCUMENTS

| | | | | |
|---|---|---|---|---|
| 4,699,679 | A * | 10/1987 | Cartmell et al. | 156/242 |
| 2002/0124948 | A1* | 9/2002 | Mikkelsen et al. | 156/247 |
| 2008/0289746 | A1* | 11/2008 | Pfitzner et al. | 156/193 |
| 2009/0025875 | A1* | 1/2009 | Hagman | 156/344 |
| 2009/0205781 | A1* | 8/2009 | Merrill et al. | 156/344 |
| 2010/0108265 | A1* | 5/2010 | Tillement et al. | 156/389 |
| 2014/0299278 | A1* | 10/2014 | Previty et al. | 156/719 |

FOREIGN PATENT DOCUMENTS

| | | | |
|---|---|---|---|
| EP | 1974899 | A2 | 10/2008 |
| JP | 05-124136 | A | 5/1993 |
| JP | 2009-023094 | A | 2/2009 |
| WO | 02/072351 | A1 | 9/2002 |

OTHER PUBLICATIONS

Extended European Search Report dated Dec. 3, 2013, issued in European Patent Application No. 13179267.3 (3 pages).

* cited by examiner

*Primary Examiner* — Mark A Osele
(74) *Attorney, Agent, or Firm* — Westerman, Hattori, Daniels & Adrian, LLP

(57) ABSTRACT

A waste removing method capable of easily carrying out a waste removing operation to peel a label sheet waste off a base sheet. A label sheet 4*b* of label paper 4 being conveyed along a path of label paper conveyance 1 is formed with a cut line 4*h* for peeling-off; an upstream side portion 4*i* of label sheet bordered and starting with the cut line 4*h* is peeled off a base sheet 4*a*, and the portion of label sheet 4*b* peeled off is carried to and wound onto a waste take-up member 20 whereby winding the peeled-off portion of label sheet 4*b* onto the waste take-up member 20 causes a label sheet waste 4*g* of succeeding label paper 4 to be peeled off the base sheet 4*a* and taken up onto the waste take-up member. The waste removing operation can be carried out automatically.

5 Claims, 6 Drawing Sheets

LABEL PAPER WASTE REMOVING METHOD AND APPARATUS

BACKGROUND OF THE INVENTION

1. Technical Field

The present invention relates to a label paper waste removing method and apparatus for peeling off and removing from a base sheet of label paper, a portion of waste, i.e. a portion that is becoming unnecessary, of a label sheet of label paper.

2. Background Art

Label manufacturing machines have hitherto been proposed in which a label sheet (label medium) of label paper is printed on whereafter the label sheet is die-cut to form label pieces. A portion of waste, i.e. a portion that is becoming unnecessary, of the label sheet, except label pieces, is peeled off and eliminated, i.e. removed from a base sheet to yield a label product having label pieces stuck to the base sheet.

Waste removing apparatuses for peeling off and removing from a base sheet, a portion of waste as mentioned above have been disclosed in JP H05-124136 A and JP 2009-23094 A. The waste removing apparatus disclosed in JP H05-124136 is of a structure having a path of label paper conveyance (path of supply of tack paper) midway of which a peeling-off roller and a waste take-up unit (punching waste take-up unit) above the roller are disposed.

The waste removing apparatus disclosed in JP 2009-23094 is of a structure having a path of label paper conveyance (path of conveyance of label material) midway of which a waste removing-up roller and a waste take-up unit (waste removing take-up unit) above the roller are disposed.

In both these waste removing apparatuses, a waste portion is removed as follows:

Continuous label paper conveyed along a path of conveyance is printed on by a printing unit and thereafter half-cut (a label sheet alone being cut along contours of a label piece) by a die cutting unit. Then, in the state that the half-cut portion of label paper has been passed through the peeling roll and the waste removing roll, the label paper conveying and the printing and the die cutting units are suspended of their driving operations. In this stage, a portion of waste of label sheet is peeled manually off a base sheet and an end of the waste portion peeled off is manually passed up to a waste take-up unit and manually fastened to the waste take-up unit.

Subsequently, the label paper is conveyed and the printing and die cutting units are driven, waste then being continuously peeled off the base sheet and taken on the waste take-up unit, namely removed.

By removing a waste of a label sheet as mentioned above, there have been manufactured a label product having label pieces stuck on a base sheet.

A waste removing method using the conventional waste removing apparatus, which requires as mentioned above that when waste removing is commenced a waste of label sheet be manually peeled off, and an end portion of the peeled-off waste be manually passed up to the waste take-up unit and be fastened manually to the waste take-up unit, entails cumbersome manual operations at the time that waste removing is commenced, and hence is poor in efficiency of waste removing operation.

In view of problems as mentioned above, it is an object of the present invention to provide a label paper waste removing method and apparatus which eliminates the need to manually operate at the time that waste removing is initiated.

DISCLOSURE OF THE INVENTION

In accordance with the present invention there is provided a label paper waste removing method which comprises the steps of:

forming a label sheet of label paper with a cut line for peeling off which is continuous widthwise thereof;

peeling off a base sheet an upstream side portion of sheet of label paper bordered and starting with the cut line, the label paper being conveyed along a path of label paper conveyance;

carrying the portion of label sheet peeled off to a waste take-up means, and winding onto the waste take-up means, the portion of label sheet carried to the waste take-up means, whereby winding the portion of label sheet onto the waste take-up means causes a label sheet waste of succeeding label paper to be peeled off the base sheet and taken up onto the waste take-up means.

Specifically in the label paper waste removing method of the present invention, the upstream side portion of label sheet bordered and starting with the cut line is peeled off the base sheet while label paper is conveyed as it is being bent at a sharp angle in a region of the path of label paper conveyance, and after the portion of label sheet peeled off is wound onto the waste take-up means, label paper is conveyed linearly over the region of the path of conveyance and the label sheet waste is then peeled off by a waste peeling-off member.

Consequently, it is ensured that bordered and starting with the cut line, the upstream side portion of label sheet which becomes a label sheet portion as a waste having its leading end constituted by the cut line can be peeled off the continuous base sheet and hence that only a label sheet waste can thereafter be peeled off the continuous base sheet, leaving label pieces stuck to and kept intact on the base sheet.

In the label paper waste removing method of the present invention, it is specifically noted that in the state that the label paper is set in the path of label paper conveyance, the cut line for peeling-off may be formed by a cutout processing means for half-cutting the label paper.

Utilizing a cutout processing means for half-cutting label paper in the label manufacturing process, it is ensured that the cut line for peeling-off to be formed readily.

The present invention also provides a label paper waste removing apparatus which comprises:

a peel-off initiating mechanism operative to peel off a base sheet an upstream side portion of the label sheet bordered and starting with a cut line for peeling-off; and a label sheet conveyer means and a waste take-up means, the label sheet conveyer means being operative to carry to the waste take-up means, the portion of label sheet peeled off by the peel-off initiating mechanism, to wind it onto the waste take-up means, whereby winding the portion of label sheet peeled off onto the waste take-up means causes a label sheet waste of succeeding label paper automatically to be peeled off the base sheet and taken up onto the waste take-up means.

Specifically in the label paper waste removing apparatus of the present invention, the peel-off initiating mechanism includes a peeling-off initiating member and a guide roll for peeling-off initiation, the guide roll being movable between a peeling-off position and a retraction position which are lower and upper than path of label paper conveyance, respectively, such that the guide roller for peeling-off initiation when in the peeling-off position and the said peeling-off initiating member allow the label paper to be conveyed while it is being bent at a sharp angle, thereby peeling off the upstream side portion of label sheet bordered and starting with the cut line, and the label sheet conveyer means includes a vacuum conveyer disposed above the peeling-off initiating member for carrying the peeled-off portion of label sheet while it is attracted to the conveyer by vacuum to the waste take-up means, the vacuum conveyer being movable between its carrying position and retraction position at which it is in contact with and remote from the waste take-up means, respectively.

With a peeling-off initiating mechanism having a peeling-off initiating member and a guide roll for peeling-off initiation which allow label paper to be conveyed as it is being bent at a sharp angle and with a vacuum conveyer, it is ensured that the label sheet portion as a waste can be peeled off the continuous base sheet and can be carried as it is attracted to the vacuum conveyer to the waste take-up means.

And, with the vacuum conveyer which having conveyed the label sheet portion as a waste to the waste take-up means is designed to move to its retraction position, it is ensured that the initial label sheet portion of waste being then no longer affected by the vacuum conveyer can be taken up onto the waste take-up means.

Specifically, the label paper waste removing apparatus of the present invention may further include a label waste peeling-off member which is movable above the path of label paper conveyance between a retraction position that is upstream of the vacuum conveyer and a peeling-off position that is downstream of the vacuum conveyer and upstream of the guide roller for peeling-off initiation in the retraction position such that the label waste peeling-off member when in the peeling-off position lies in contact with the label sheet waste being taken up onto the waste take-up means, thereby peeling the label sheet waste off the continuous base sheet.

It is enabled to follow consequently that by the label waste peeling-off member moved to lie at the peeling-off position from the retraction position, a label sheet waste is switched to directly lead to the peeled-off label sheet waste taken up onto the waste take-up means and is then peeled off from label paper traveling in the path made linear.

Specifically in the label paper waste removing apparatus of the present invention, the label waste peeling-off member is a label waste peeling-off roll and the vacuum conveyer is movable to a second retraction position providing a space for a waste peeling-off roll to pass between a lower end of the vacuum conveyer and the path of label paper conveyance.

With a label waste peeling-off roll as mentioned above, it follows consequently that only a label sheet waste of continuous label sheet can be peeled off the continuous base sheet.

Also, the label sheet peeling-off roll can easily be moved between the retraction and peeling-off positions.

According to the present invention, the need to include manual operations at the time of commencement of waste removing is eliminated, permitting a waste removing operation to be carried out automatically and with enhanced efficiency.

BEST MODES FOR CARRYING OUT THE INVENTION

Figure 1:
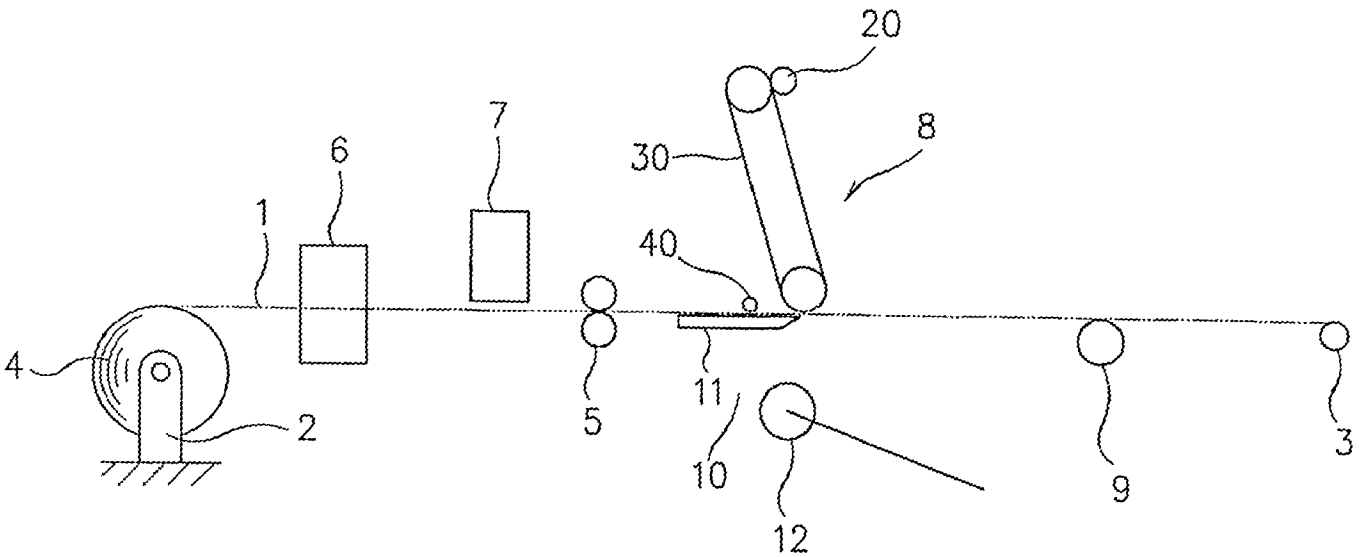
FIG. 1 is a diagrammatic explanatory view of a label manufacturing machine.

As shown in FIG. 1, a label manufacturing machine provided with a waste removing apparatus according to the present invention includes a label paper mounting unit 2 and a product take-up unit 3 disposed on the upstream and downstream sides of a path of label paper conveyance 1, respectively.

Continuous label paper 4 wound onto the label paper mounting unit 2 is so mounted that it can freely be unwound. The label paper 4 unwound from the unit 2 is conveyed along the path of label paper conveyance 1 by feed rollers 5 or the like and taken up onto the product take-up unit 3.

In the path of label paper conveyance 1 there are provided a printing unit 6, a cutout processing unit 7, a waste removing apparatus 8 of the present invention, a guide roll 9 and such disposed in the order shown.

Figure 2:
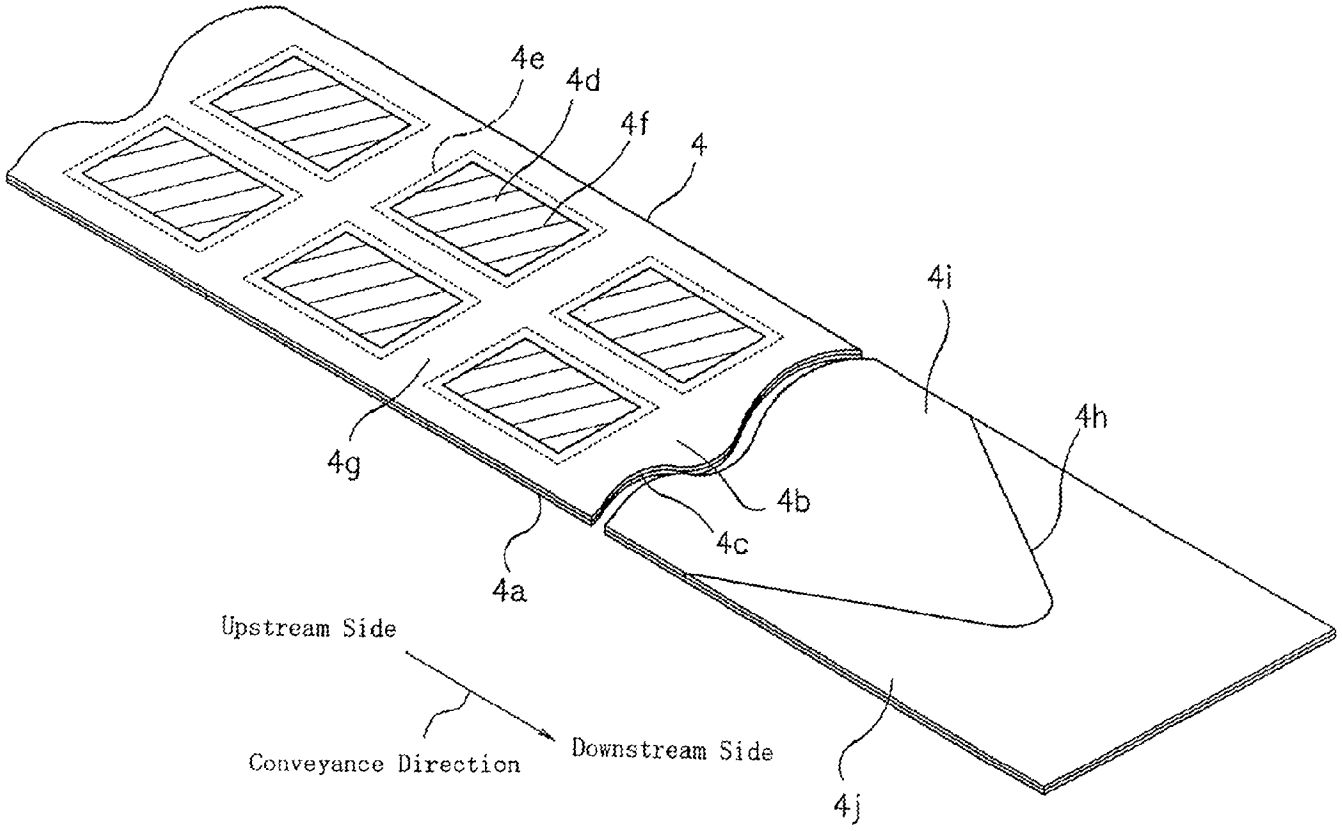
FIG. 2 is a perspective view illustrating portions of a label paper.

Label paper 4 as shown in FIG. 2 is comprised of a continuous base sheet 4*a* and a continuous label sheet 4*b* stuck together with a pressure-sensitive adhesive 4*c*. An image 4*d* is printed on the label sheet 4*b* by the printing unit 6 and the label paper 4 so printed on is half-cut by a cutout processing unit 7, i.e. only the label sheet 4*b* is there cut into a cutout line 4*e* along a shape of a label piece, the cutout line 4*e* surrounding the label piece 4*f*. Of the label sheet 4*b*, portions other than such label pieces 4*f* are becoming unnecessary, constituting a label sheet waste 4*g*.

In addition to the half-cutting function mentioned above, the cutout processing unit 7 is provided with a cutting function of half-cutting label paper 4 for label sheet peeling-off at downstream of the most downstream image 4*d* thereon, i.e. only the label sheet 4*b* is cut over a full length of its width with a cut line formed to be trans-verse to the direction of the path of label paper conveyance 1.

The cut line 4*h* constituting a boundary between a portion of upstream side 4*i* and a portion of downstream side 4*j* of continuous label sheet 4*b* in the direction of the path of label paper conveyance 1, the upstream side portion 4*i* bordered and starting with the cut line 4*h* is peeled off the continuous base sheet 4*a* by the waste removing apparatus 8 while the downstream portion 4*j* as it is left stuck intact on the continuous base sheet 4*a* is wound onto the product take-up unit 3.

The cut line 4*h* for peeling-off is shaped to be symmetrically tapered towards downstream, e.g. in the form of V having a rounded tip or U having a taped tip or oval, i.e., a shape that renders a portion starting with the cut line 4*h* more readily capable of being peeled off.

While in the form of implementation illustrated the cutout processing unit 7 is shown to be a laser cutting apparatus using laser beam, it may be of another type, for example, a die cutting apparatus.

A processing unit for forming the cut line 4*h* for label sheet peeling-off as mentioned above may be provided independently of the cutout processing unit 7.

The waste removing apparatus 8 mentioned above includes an peel-off initiating mechanism 10 for peeling off the base sheet 4*a*, the upstream side portion 4*i* of label sheet 4*b* bordered and starting with the peeling-off cut line 4*h*, over a full length of the width of the label sheet 4*b*, a label sheet conveyer member 30 for carrying a leading end portion (portion downstream in the conveyance direction) of label sheet 4*b* peeled off, to a waste take-up member 20 and fastening that end portion onto the waste take-up member 20, and a waste peeling-off member 40 for peeling off the base sheet 4*a*, then only a waste portion 4*g* of label sheet 4*b*.

The peel-off initiating mechanism 10 includes a peeling-off plate 11 as a peel-off initiating member and a guide roll 12 for peeling-off initiation. When disposed in position of peeling-off as shown in FIG. 1, they act to automatically peel the upstream side portion 4 of label sheet 4*b* of label paper 4 off the base sheet 4*a* as described above.

Figure 3:
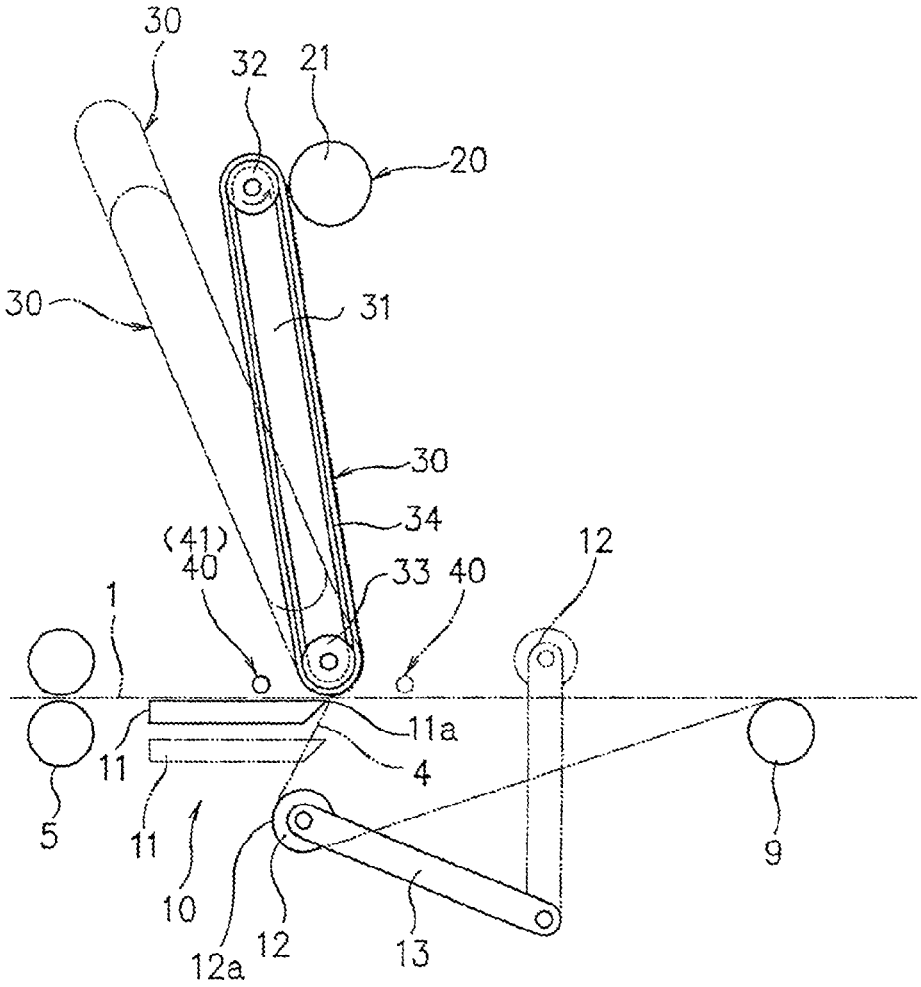
FIG. 3 is an enlarged explanatory view of a waste removing apparatus.

Mention is made of details of the waste removing apparatus 8 with reference to FIG. 3.

The peeling-off plate 11 is a plate shaped to have a sharp downstream end portion 11*a* and is movable between a peeling-off position as indicated by a solid line in FIG. 3 in which the downstream end portion 11*a* lies equal in height to the path of label paper conveyance 1 and a retraction position as indicated by a phantom line in FIG. 3 in which it lies away from and lower than the path of label paper conveyance 1.

For example, the peeling-off initiating plate 11 can be connected to a fixed side in a parallel link (not shown) which can in turn be moved back and forth by an actuator such as a cylinder to move the peeling-off plate 11 parallel between the peeling position and the retraction position.

Alternatively, the peeling-off plate 11 can be made movable along a guide provided in a fixed side (not shown) so that it may be moved by an actuator such as a cylinder.

The guide roll 12 for peeling-off initiation is made movable between a peeling-off position as indicated by a solid line and a retraction position as indicated by a phantom line in FIG. 3.

For example, it may have a pair of arms 13 whose bases are pivotally coupled to a fixed side (not shown) so that they may be swung vertically. And, the peeling-off guide roll 12 at its axially longitudinal ends is rotatably coupled to the ends of the arms 13 so that causing the arms to be vertically swung by an actuator such as a cylinder allows the peeling-off guide roll 12 to be moved between its peeling-off position and retraction position under and above the path of label paper conveyance 1, respectively.

It is noted that a pair of the arms 13 are positioned at both sides of the path of label paper conveyance 1 in a direction perpendicular to the label conveyance direction so that they may not interfere with the label paper 4.

And, when the peeling-off guide roll 12 lies at the peeling-off position, an upstream portion of its peripheral surface 12*a* is positioned upstream of, and lower than, the downstream end 11*a* of the peeling-off plate 11 lying at its peeling-off position.

This allows the leading end portion of label paper 4 wound on the peeling-off guide roll 12 from the downstream end 11*a* of the initial peeling-off plate 11 to be bent at a sharp angle as indicated by a phantom line n FIG. 3 whereby the upstream side portion 4*i* of label sheet 4*b* bordered and starting with the peeling-off cut line 4*h* is made more readily capable of being peeled off the base sheet 4*a*.

When the peeling-off guide roll 12 lies at its retraction position, it is positioned above the path of label paper conveyance 1 and downstream of the label sheet conveyer member 30, ensuring that the guide roll 12 may not interfere with the label paper 4 conveyed along the path of label paper conveyance 1.

The waste take-up member 20 has a cylinder (not shown) detachably mounted to a take-up shaft 21 for rotation by a motor (not shown). On this cylinder is wound the label sheet 4*b* as a waste peeled off. Dismounting the cylinder from the take-up shaft 21 allows a waste wound thereon to be detached.

The label sheet conveyer member 30 may comprise a vacuum conveyer by which the portion of label paper 4*b* peeled off is attracted thereto by vacuum and carried to the waste take-up member 20.

For example, the label sheet conveyer member 30 has a vacuum box 31, a pair of driving rolls 32 and a pair of driven rolls 33. The driving rolls 32 and driven rolls 33 are rotatably mounted at the widthwise ends of the upper and lower longitudinal ends of the vacuum box 31, respectively. And, a perforated belt 34 is wound on the driving rolls 32 and the driven rolls 33. Rotating the driving rolls 32 by a motor (not shown) while giving a negative pressure within the vacuum box 31 allows the belt 34 to be turned and the portion of label paper 4*b* peeled off to be attracted to the belt 34 and to be conveyed on the belt 34 as it is.

The label conveyer member 30 is designed to swing on its lower end between a carrying position as indicated by a solid line in FIG. 3 at which the belt 34 is in contact with the waste take-up member 20 (cylinder) and a first retraction position as indicated by a phantom line there at which the belt 34 is away from the waste take-up member 20 and movable to a second retraction position as indicated by one dot chain line at which the belt 34 is displaced by a distance obliquely upwards from the first retraction position.

When the label sheet conveyer member 30 lies at the second retraction position, its lower end is positioned above the waste peeling-off member 40.

For example, with the lower end of the vacuum box 31 pivotally mounted to an eccentric portion of a shaft, the vacuum box 31 can be turned by an actuator such as a cylinder to move the label sheet conveyer member 30 to the first retraction position. And, the shaft may be rotated to move the label sheet conveyer member 30 to the second retraction position.

Alternatively, a plate (not shown) may be mounted to a fixed side so as to be movable up and down and an actuator such as a cylinder mounted between the plate and the fixed side while the rotational central axis of a driven roll 33 may be pivotally coupled to the plate and an actuator such as a cylinder mounted between the plate and the vacuum box 31.

The waste peeling-off member 40 may comprise a waste peeling-off roll 41 which is disposed above the path of label paper conveyance 1 and movable between its retraction position as indicated by a solid line in FIG. 3 and its peeling-off position as indicated by a phantom line there. The waste peeling-off roll 41 may be so movable by a movement mechanism having an actuator such as a cylinder. The waste peeling-off roll 41 when at its retraction position is positioned in a region upstream of both the downstream end 11*a* of the peeling-off plate 11 at its peeling position and the label sheet conveyer member 30 at its carrying position, and when at its peeling-off position is positioned in a region downstream of both the downstream end 11*a* of the peeling-off plate 11 at its peeling position and the label sheet conveyer member 30 at its carrying position.

The waste peeling-off roll 41 is smaller in diameter than the driven rolls 33 of the label sheet conveyer member 30 (vacuum conveyer). Thus, the waste peeling-off roll 41 which when at its peeling-off position is positioned downstream of the label sheet conveyer member 30 and upstream of the peeling-off guide roll 12 at its retraction position, ensures that the waste portion 4*g* alone of the label sheet 4*b* can be peeled off the base sheet 4*a*.

Figure 4:
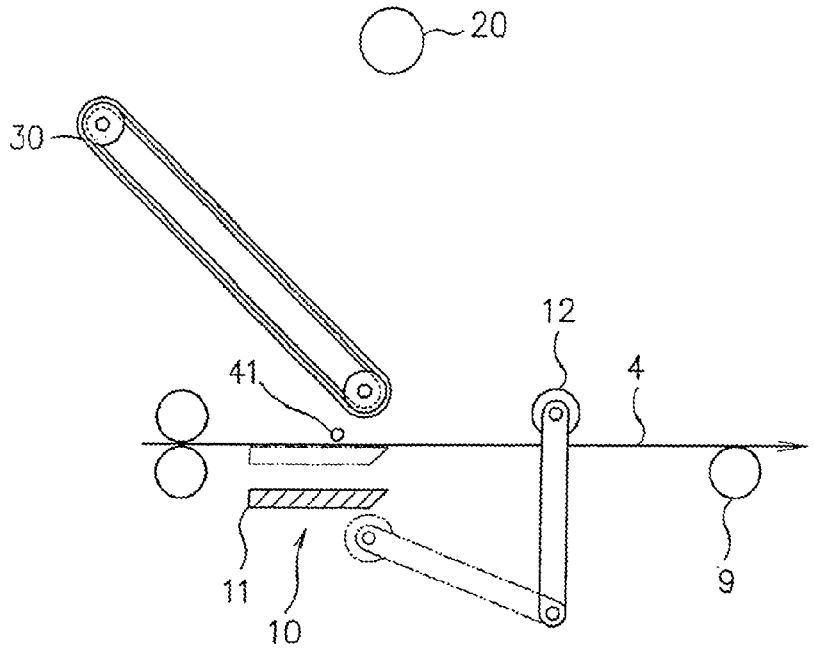
FIG. 4 is an explanatory view of a waste removing operation.

Mention is next made of a label manufacturing process using the label manufacturing machine. Label paper setting step: Label paper 4 which has not undergone printing the image 4*d*, half-cutting and cutting for label sheet peeling-off is set by mounting it to the label paper mounting member 2 and passing it from its leading end along the path of label sheet conveyance 1 through the printing unit 6, the cutout processing unit 7 and the waste removing unit 8 onto the product take-up member 3 on which the leading end is wound. At this time, as shown in FIG. 4 the peeling-off guide roll 12 is at its retraction position and positioned above the label paper 4 passed through the entire path, where the waste peeling-off roll 41 is at its retraction position. Also, the peel-off initiating plate 11 is positioned at its retraction position and the label sheet conveyer member 30 at its second retraction position where they are spaced from the path of label paper conveyance 1, making it easy to pass the label paper 4 through.

Step of Peeling-Off Preparation

Figure 5:
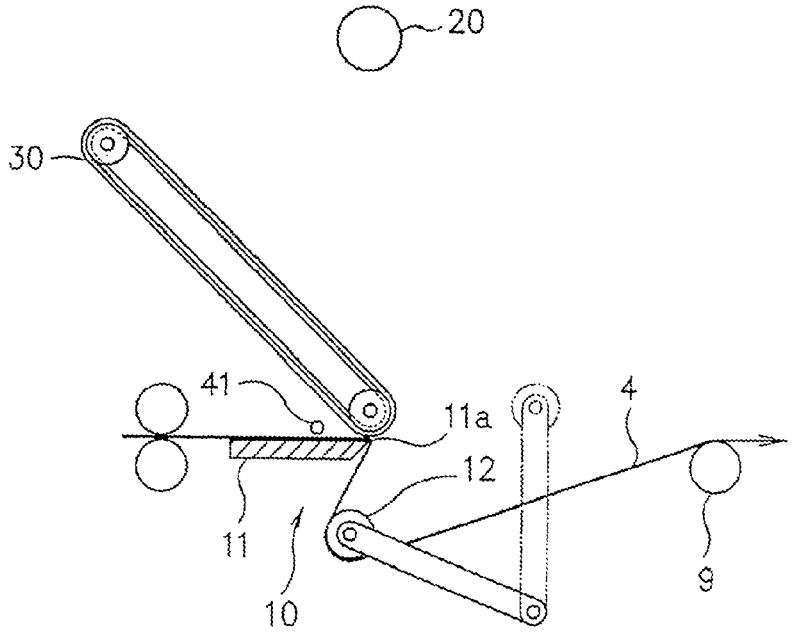
FIG. 5 is an explanatory view of a waste removing operation.

As shown in FIG. 5, the peel-off initiating plate 11 is moved to its peeling-off position and the peeling-off initiating guide roll is moved to its peeling-off position, making it possible for the peel-off initiating mechanism 10 automatically to peel the label sheet as a waste off.

The label sheet conveyer member 30 is moved to the first retraction position to bring its lower end into contact with the path of label paper conveyance 1 while the waste peeling-off roll 41 is held at its retraction position.

Step of Cutting the Label Sheet to Peel it Off

The peeling-off cut line 4*h* is formed on the label sheet 4*b* by the cutout processing unit 7.

This step of cutting the label sheet to peel it off may be performed before the label paper 4 is set.

Step of peeling the label sheet off: While the label paper 4 is being conveyed and taken up onto the product take-up member 3, the driving roll 32 of the label sheet conveyer member (vacuum conveyer) 30 is rotated to turn the belt 34 and the vacuum box 31 is evacuated (air therein is sucked out) by a vacuum pump not shown to bring the vacuum conveyer into the state of attracting and turning.

Figure 6:
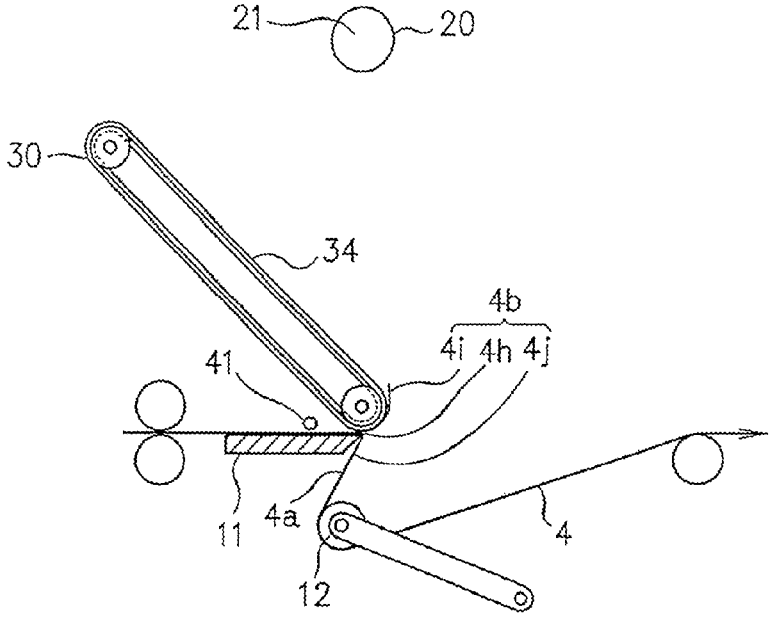
FIG. 6 is an explanatory view of a waste removing operation.

From this, it follows as shown in FIG. 6 that while the label paper 4 is conveyed from the downstream side end 11*a* of the peel-off initiating member 11 to the peeling-off guide roll 12 as it is being bent there at a sharp angle, the upstream side portion 4*i* of label sheet 4*b* bordered and starting with the peeling-off cut line 4*h* continuous widthwise thereof is peeled off the base sheet 4*a*. And, the portion, i.e. leading portion as a waste, of label sheet 4*b* is attracted to the belt 34 and is moved upwards as it is whereas the downstream side portion 4*j* of label paper 4 bordered and starting with the peeling-off cut line 4*h* and held stuck to the base sheet 4*a* is conveyed as it is, past the peeling-off guide roll 12 and then taken up onto the product take-up member 3.

Label Sheet Carrying Step

Figure 7:
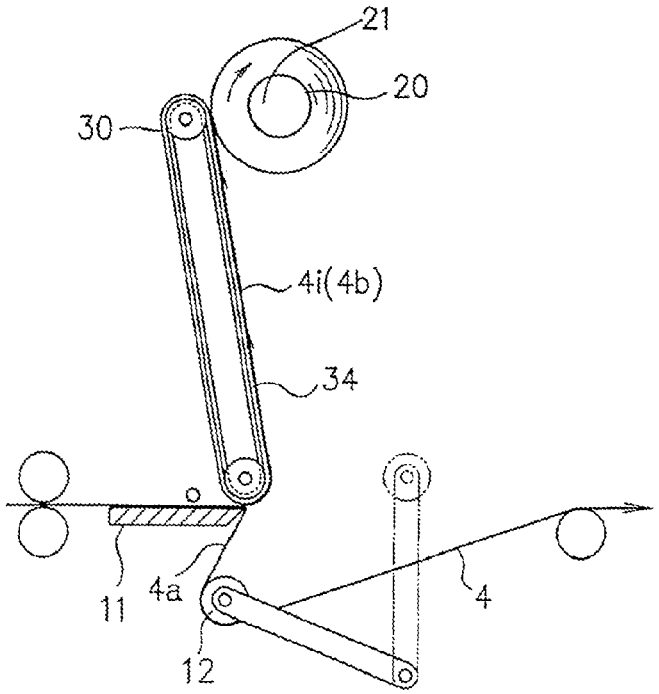
FIG. 7 is an explanatory view of a waste removing operation.

As shown in FIG. 7, the label conveyer member (vacuum conveyer) 30 is swung to its carrying position to bring the belt 34 into contact with the cylinder of the take-up shaft 21 in the waste take-up member 20. The portion of label sheet 4*b* coming attracted to the belt 34 and carried is stuck onto the cylinder (in the waste take-up member 20) and taken up thereon, thus conjointly by the conveyer and take-up members 30 and 20.

Here, the leading portion of label sheet 4*b* is stuck to the cylinder by pressure-sensitive adhesive 4*c*.

Step of Waste Take-Up Preparation

Figure 8:
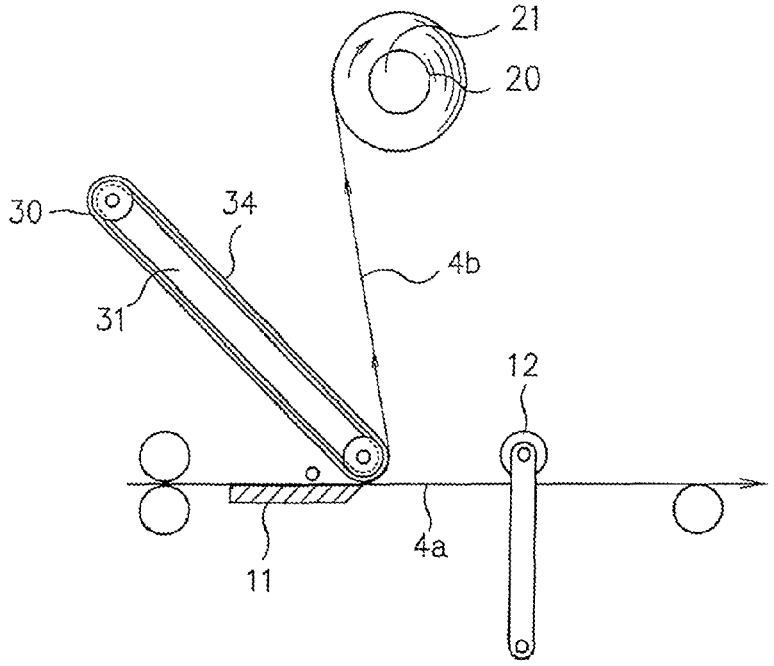
FIG. 8 is an explanatory view of a waste removing operation.

As shown in FIG. 8, the label sheet conveyer (vacuum conveyer) 30 is moved again to the first retraction position to set the belt 34 and the label sheet 4*b* apart from each other and evacuation (air suction) in the vacuum box 31 of the label conveyer member (vacuum conveyer) 30 is cut off, bringing the member 30 into the state that the label sheet 4*b* is not attracted to the belt 34 (i.e. the state of non-attracting and turning). The peeling-off guide roll 12 is moved to the retraction position so that the base sheet 4*a* from which the label sheet 4*b* is peeled off is guided thereby to pass linearly along the path of label paper conveyance 1 up to the product take-up member 3.

Step of Moving the Waste Peeling-Off Member

Figure 9:
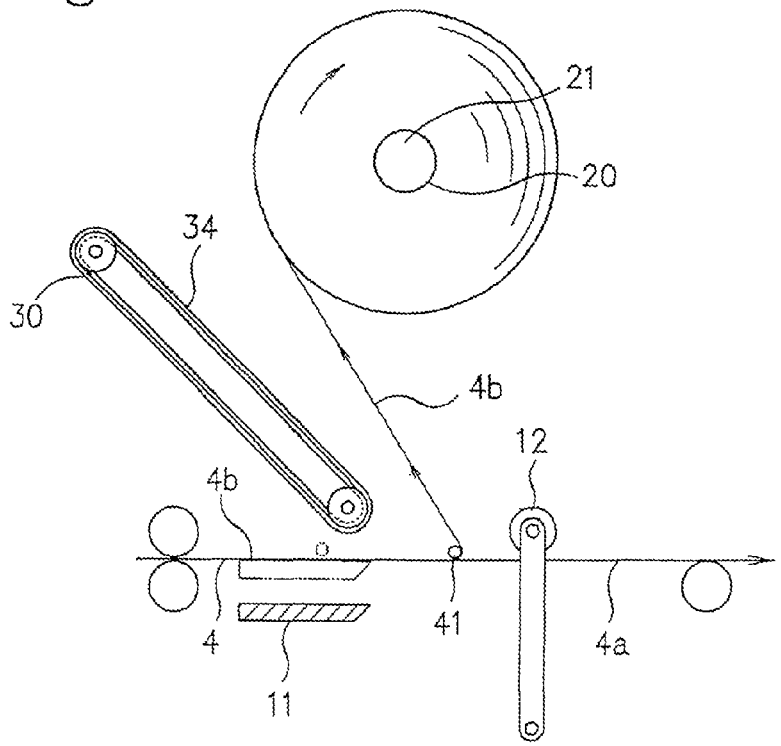
FIG. 9 is an explanatory view of a waste removing operation.

As shown in FIG. 9, the label sheet conveyer member (vacuum conveyer) 30 is moved to the second retraction position so that the waste peeling-off roll 41 can pass in a space made between the lower end of the vacuum conveyer (the belt 34) and the label sheet 4*b*, the peeling-off roll 12 having been moved to the retraction position.

Should there be an interference of any portion of a movement mechanism moving the waste peeling-off member 41 with the peeling-off plate 11 as mentioned above, the peeling-off member 11 is moved to the retraction position. If there is not, the peeling-off plate 11 may remain positioned at the peeling-off position, making it unnecessary to construct the peeling-off plate 1 to be movable to a retraction position.

Step of Peeling a Waste Off

Arrangements as illustrated and mentioned above allow the label sheet 4*b* of label paper 4 to be peeled off a base sheet 4*a* by a waste peeling-off member 41 and taken up onto a waste take-up member 20 and meanwhile the base sheet 4*a* of label paper 4 to be taken up onto a product take-up member 3, establishing a waste removing state.

In the waste removing state, an image 4*d* is printed by the printing unit 6 that is followed by the cutout processing unit 7 for half-cutting.

And, a label sheet waste 4*g* of the label sheet 4*b* is peeled off the base sheet 4*a* by a waste peeling-off roll 41 and taken into the waste take-up member 20 while the base sheet 4*a* having label pieces 4*f* left thereon and stuck thereto intact and with the label pieces 4*f* held so is taken up as a product onto the product take-up member 3.

Waste removing by allowing a waste 4*g* of a label sheet 4*b* to be automatically peeled off and automatically taken up onto a waste take-up member 20 as mentioned above eliminates any need for a manual operation at the time to initiate waste removing, hence enhancing the efficiency of a waste removing operation.

In the steps of waste take-up preparation and moving the waste peeling-off member, the label manufacturing machine may temporarily be suspended of its operation (stop each member and conveyance of label sheet 4) to take out from the product take-up member 3, a portion of label paper 4 containing a downstream side portion 4*j* of label sheet 4*b* taken up in paper passing at a first time and a portion of base sheet 4*a* from which an upstream side portion 4*i* of label sheet 4*b* is peeled off (and which has no label piece), that is to say, a portion of label paper 4 other than a portion of base sheet 4*a* having only label pieces 4*f* stuck thereon (a product as mentioned above), thereby allowing a base sheet 4*a* having only label pieces 4*f* stuck thereon (a product as mentioned above) to be taken up onto the product take-up member 3.

The form of implementation illustrated and mentioned above in which while label paper 4 is being bent at a sharp angle in a peeling-off initiating mechanism 10, an upstream side portion 4*i* of label sheet 4*b* bordered and starting with a peeling-off cut line 4*h* is peeled off a base sheet 4*a*; the label sheet 4*b* peeled off is carried by a label sheet conveyer member 30 to a waste take-up member 20 and taken up thereon; and subsequently label sheet 4*b* is linearly conveyed, is peeled off by a waste peeling-off member 40 (waste peeling-off roll 41) different from the label sheet conveyer member 30 and is taken up onto the waste take-up member 20, ensures that the upstream side portion 4*i* of label sheet 4*b* bordered and starting with the peeling-off cut line 4*h* can be peeled off and further that only a waste 4*g* of the label sheet 4*b* can be peeled off.

To wit, while a waste 4*g* of label sheet 4*b* may be peeled off while label paper 4 is conveyed while it is being bent at a sharp angle, this gives rise to a fear of peeling a label piece 4*f* off the base sheet 4*a* (product). In this form of implementation, the label sheet 4*b* is linearly conveyed so that only the waste 4*g* can be peeled off by the waste peeling-off member 40.

Moreover, a waste peeling-off roll 41 constituting the waste peeling-off member has a diameter which is preferably smaller than that of the driven roll 33, further ensuring that only the waste 4*g* can be peeled off.

While in the form of implementation illustrated and mentioned above it is shown that label paper is printed on a label sheet and half-cut at the time after peeling-off of the label sheet 4*b* as a waste is initiated, the printing and half-cutting steps can be performed at any of possible timings, preferably after the upstream side portion 4*i* of label sheet 4*b* bordered and starting with the peeling-off cut line 4*h* is peeled off the base sheet 4*a*.

The peeling-off member 11 of the peeling-off initiating mechanism 10 may be a roll and the waste peeling-off member 40 may be a peeling-off plate.

What is claimed is:

1. A label paper waste removing method, characterized in that it comprises steps of:

forming a label sheet of label paper with a cut line for peeling off which is continuous widthwise thereof;

peeling off a base sheet an upstream side portion of sheet of label paper bordered and starting with said cut line, the label paper being conveyed along a path of label paper conveyance;

carrying said portion of label sheet peeled off to a waste take-up means; and winding onto said waste take-up means, said portion of label sheet carried to the waste take-up means, whereby winding the portion of label sheet onto the waste take-up means causes a label sheet waste of succeeding label paper to be peeled off the base sheet and taken up onto the waste take-up means, wherein said upstream side portion of label sheet bordered and starting with said cut line is peeled off said base sheet while label paper is conveyed as it is being bent at a sharp angle in a region of the path of label paper conveyance; and after said portion of label sheet peeled off is wound onto said waste take-up means, label paper is conveyed linearly over said region of the path of conveyance and the label sheet waste is then peeled off by a waste peeling-off member.

2. The label paper waste removing method as set forth in claim 1, characterized in that in the state that the label paper is set in said path of label paper conveyance, said cut line for peeling-off is formed by a cutout processing means for half-cutting the label paper.

3. A label paper waste removing apparatus comprising:

a peel-off initiating mechanism operative to peel off a base sheet an upstream side portion of the label sheet bordered and starting with a cut line for peeling-off; and a label sheet conveyer means and a waste take-up means, said label sheet conveyer means being operative to carry to said waste take-up means, said portion of label sheet peeled by said peel-off initiating mechanism, to wind it onto said waste take-up means, whereby winding the portion of label sheet peeled off onto the waste take-up means causes a label sheet waste of succeeding label paper to be peeled off the base sheet and taken up onto the waste take-up means, wherein said peel-off initiating mechanism includes a peeling-off initiating member and a guide roll for peeling-off initiation, said guide roll being movable between a peeling-off position and a retraction position which are lower and upper than said path of label paper conveyance, respectively, such that the guide roller for peeling-off initiation when in said peeling-off position and said peeling-off initiating member allow the label paper to be conveyed while it is being bent at a sharp angle, thereby peeling off said upstream side portion of label sheet bordered and starting with said cut line, and said label sheet conveyer means includes a vacuum conveyer disposed above said peeling-off initiating member for carrying said peeled-off portion of label sheet while it is attracted to the conveyer by vacuum to said waste take-up means, said vacuum conveyer being movable between its carrying position and retraction position at which it is in contact with and remote from said waste take-up means, respectively.

4. The label paper waste removing apparatus as set forth in claim 3, characterized in that it further includes a label waste peeling-off member which is movable above said path of label paper conveyance between a retraction position that is upstream of said vacuum conveyer and a peeling-off position that is downstream of the vacuum conveyer and upstream of said guide roller for peeling-off initiation in the retraction position such that said label waste peeling-off member when in the peeling-off position lies in contact with the label sheet waste being taken up onto said waste take-up means, thereby peeling the label sheet waste off the base sheet.

5. The label paper waste removing apparatus as set forth in claim 4, characterized in that said label waste peeling-off member is a label waste peeling-off roll and said vacuum conveyer is movable to a second retraction position providing a space for said waste peeling-off roll to pass between a lower end of said vacuum conveyer and said path of label paper conveyance.

* * * * *